US006398064B1

(12) United States Patent
Cornwall

(10) Patent No.: US 6,398,064 B1
(45) Date of Patent: Jun. 4, 2002

(54) INSERT FOR A LIQUID VESSEL, AND LIQUID VESSEL

(76) Inventor: Roger William Cornwall, 260 Penns Lane, Sutton Coldfield, B76 1LQ (GB)

( * ) Notice: Subject to any disclaimer, the term of this patent is extended or adjusted under 35 U.S.C. 154(b) by 0 days.

(21) Appl. No.: 09/596,534

(22) Filed: Jun. 16, 2000

(30) Foreign Application Priority Data

Jun. 18, 1999 (GB) ..... 9914147

(51) Int. Cl.[7] ..... A47G 19/22
(52) U.S. Cl. ..... 220/731
(58) Field of Search ..... 220/731

(56) References Cited

U.S. PATENT DOCUMENTS

| | | | | |
|---|---|---|---|---|
| 2,362,354 A | * | 11/1944 | Clovis | 220/719 |
| 2,428,056 A | * | 9/1947 | Wachsman | 220/719 |
| 3,940,012 A | | 2/1976 | Addington | 220/90.4 |
| 4,130,215 A | | 12/1978 | Corey et al. | 220/90.4 |
| 4,768,674 A | | 9/1988 | Prescott | 220/90.4 |
| 5,370,258 A | | 12/1994 | Fair | 220/719 |
| 5,540,350 A | | 7/1996 | Lansky | 220/380 |

FOREIGN PATENT DOCUMENTS

| | | |
|---|---|---|
| DE | 502009 | 3/1939 |
| GB | 1 114 195 | 5/1968 |
| GB | 1 489 851 | 10/1977 |

* cited by examiner

*Primary Examiner*—Joseph M. Moy

(57) ABSTRACT

This invention relates to an insert for a liquid vessel, and in particular to an anti-spillage insert to be used in conjunction with a liquid vessel, and to a liquid vessel with an insert providing anti-spillage features. According to the invention, there is provided an insert having a wall member which is adapted to span at least part of the vessel in use so as to divide a liquid present within the vessel. There is also provided a liquid vessel including an insert as defined, the wall member being adjacent the top of the vessel. A particular utility of the invention is in relation to a drinks vessel.

15 Claims, 7 Drawing Sheets

INSERT FOR A LIQUID VESSEL, AND LIQUID VESSEL

FIELD OF THE INVENTION

This invention relates to an insert for a liquid vessel, and in particular to an anti-spillage insert to be used in conjunction with a liquid vessel, and to a liquid vessel with an insert providing anti-spillage features.

The invention is likely to find its greatest utility in relation to a drinks vessel, and the following description therefore refers primarily to such a vessels. However, the utility of the invention for other liquid vessels such as cartons, dishes, vases, cooking pots, cooking pans, measuring jugs, paint pots, glue pots, watering cans, other cans, drums, buckets, pails, churns, tanks, vats, tubs and trays, as well as other domestic, commercial, agricultural, transportation and industrial vessels, is not thereby excluded.

BACKGROUND TO THE INVENTION

Conventional drinks vessels (e.g. cups, beakers, glasses, and other vessels) suffer from the disadvantage of liquid spillage either if the holder has difficulty keeping the vessel steady (e.g. neurological disorders, young children), or if the holder is situated on or in a vehicle (e.g. cars, boats, trains, aeroplanes, and other forms of transport), or if the holder is situated on or in an unstable environment (e.g. lifts, platforms, boat houses, and other environments).

Spilled liquid can cause scalding to the person if the liquid is hot, and/or can cause damage to the person's clothing or adjacent furniture or machinery.

SUMMARY OF THE INVENTION

It is the object of this invention to provide an insert for a drinks vessel, and a drinks vessel itself, which in use can significantly reduce the susceptibility for spillage.

According to the invention, therefore, there is provided an insert for a drinks vessel, the insert having a wall member which is adapted to span at least part of the vessel in use so as to divide a liquid present within the vessel.

The provision of the wall member to divide the liquid reduces the size of movement-induced disturbances in the surface of the liquid, so reducing the likelihood that those disturbances will spill over the top of the vessel.

Preferably, the wall member in use projects above the exposed surface of the liquid (or at least extends very close to that surface) when the vessel is full of liquid. The positioning of the wall member adjacent the exposed surface has a greater benefit than if the wall member is deeper within the body of the liquid. If the wall member is initially below the surface of the liquid, i.e. when the vessel is full and before the liquid has been drunk or otherwise depleted, it is preferably only a few millimeters, and preferably less than 10 mm, below that surface.

Preferably also, the wall member extends a significant way down the body of the liquid in use, i.e. the wall member occupies a significant proportion of the depth of the vessel. Thus, notwithstanding that movement-induced disturbances are only visible at the exposed surface of the liquid, those disturbances are also present within the body of the liquid, and the presence of a wall member only adjacent the exposed surface of the liquid is not likely to be fully effective. Accordingly, the wall member preferably extends all of the way, or almost all of the way, down to the bottom of the vessel. If the wall member does not extend all of the way down to the bottom of the vessel, it preferably extends to within a few millimetres, and ideally to within less than 10 mm, of the bottom.

Desirably, the wall member completely spans the vessel so that parts of the liquid are separated thereby. Desirably also, there are a number of wall members so that the liquid is divided (or separated) into a number of smaller "cells", i.e. sections of liquid with a reduced exposed surface area.

A first variant of the invention provides an insert suitable for insertion in a conventional drinks vessel and which effectively divides the drinks vessel into a number of cells of liquid of small surface area. This insert can be retained in the drinks vessel either by friction (e.g. it is a resiliently expandable structure), by virtue of its weight, or by fixing means (e.g. suction cups, friction rings, etc.) which may or may not be permanently attached to the insert.

The first variant can be tapered so as to fit into a correspondingly tapered drinks vessel, rounded so as to fit into a correspondingly rounded drinks vessel, or can be non-tapered for fitment into a parallel-sided drinks vessel.

Preferably the insert is made of plastics material, but it may instead be made of other materials (e.g. metal, ceramic, glass, resin, paper, and composite materials, etc).

Preferably the insert is readily removable and easily cleaned, adaptable to vessels of differing diameters (by virtue of being expandable, for example), and adaptable to vessels of differing depths (by virtue of being telescopic, or useable in pairs, etc., for example). The reference to "diameter" is made here since the majority of drinks vessels are of circular cross-section; however, an insert for a non-circular drinks vessel is not excluded from the invention, which insert could have a cross-sectional shape corresponding to that of the vessel it is intended to fit.

A second variant of the invention provides an "insert" which is an integral part of a drinks vessel, i.e. the insert is added to the vessel as part of the manufacturing process. In this variant the insert similarly divides the drinks vessel into a number of connected cells of liquid of smaller surface area.

Preferably the insert of this second variant is made of similar material to the drinks vessel and is manufactured as part of the drinks vessel.

BRIEF DESCRIPTION OF THE DRAWINGS

The invention will now be described, by way of example, with reference to the accompanying drawings in which.

DESCRIPTION OF THE EXEMPLARY EMBODIMENTS

Figure 1:
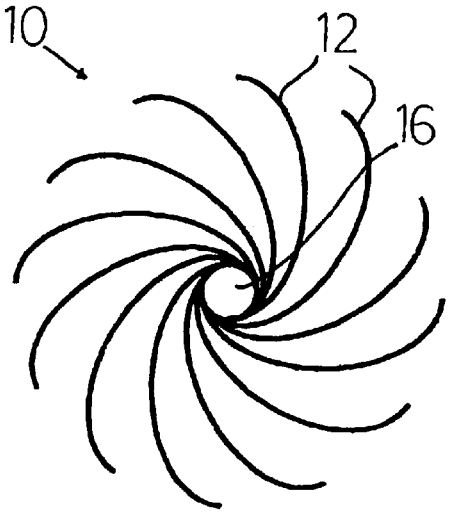
FIG. 1 shows a top view of a first embodiment of insert according to the invention.
Figure 2:
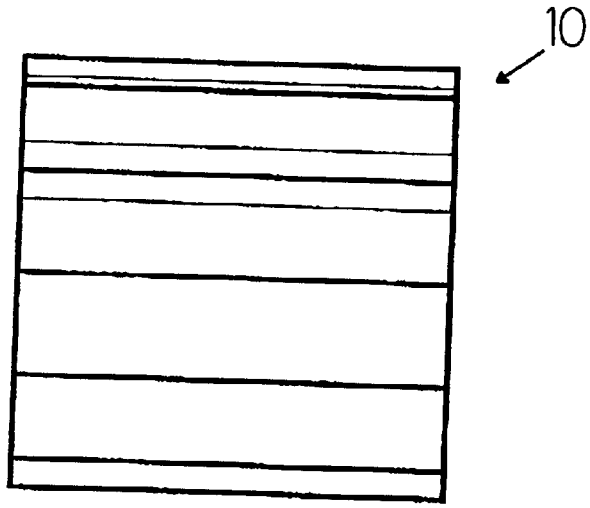
FIG. 2 shows a side view of the first embodiment.
Figure 3:
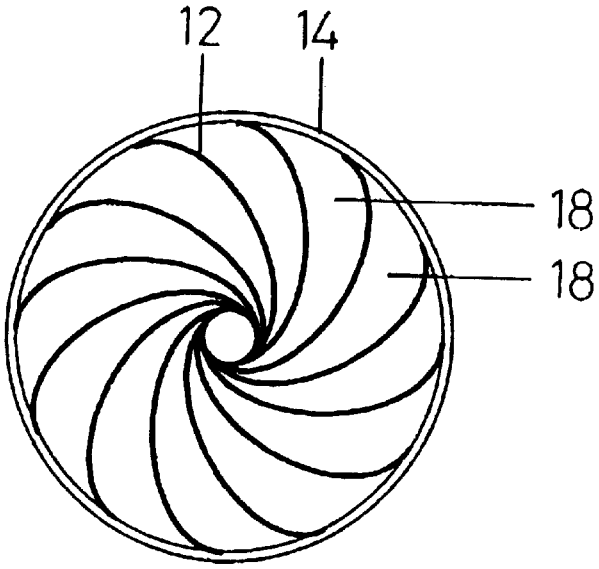
FIG. 3 show a top view of the first embodiment located in a drinks vessel.

FIGS. 1, 2 and 3 show an insert 10 with flexible spiral arms 12 (which may be parallel, tapered or rounded corresponding to the form of the drinks vessel 14 with which it is to be used). The arms 12 are joined to a central core 16 which may be solid or hollow. The insert 10 can be compressed to suit the diameter of the vessel 14, the arms 12 pivotting anticlockwise (as viewed in FIG. 1) as the insert is compressed. Separate cells 18 are created for the liquid in the vessel 14, which cells have a small area in relation to the area of the top of the drinks vessel 14.

Figure 4:
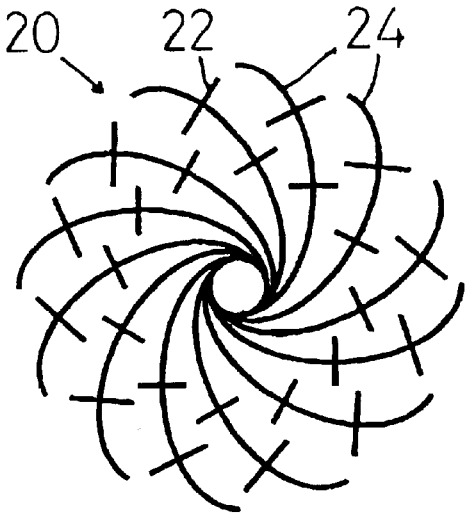
FIG. 4 shows a top view of a second embodiment of insert according to the invention.
Figure 5:
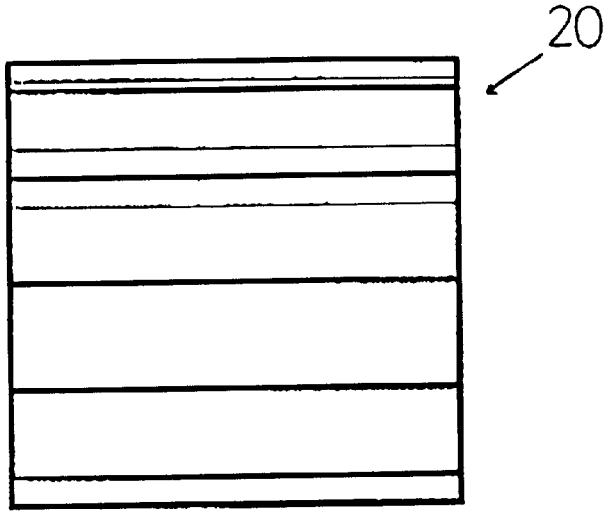
FIG. 5 shows a side view of the second embodiment.
Figure 6:
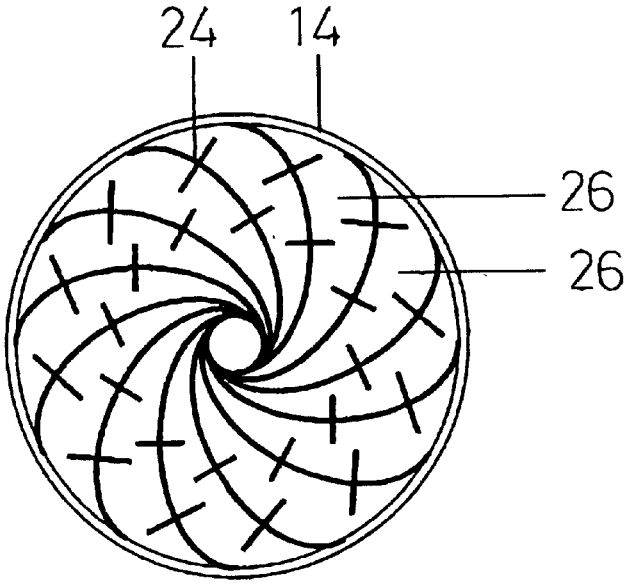
FIG. 6 show a top view of the second embodiment located in a drinks vessel.

FIGS. 4, 5 and 6 show an insert 20 which is somewhat similar to the insert 10, but which has additional vanes 22 attached to the spiral arms 24, the vanes further dividing the cells 26 for the liquid, and so further resticting the flow of liquid therein.

Figure 7:
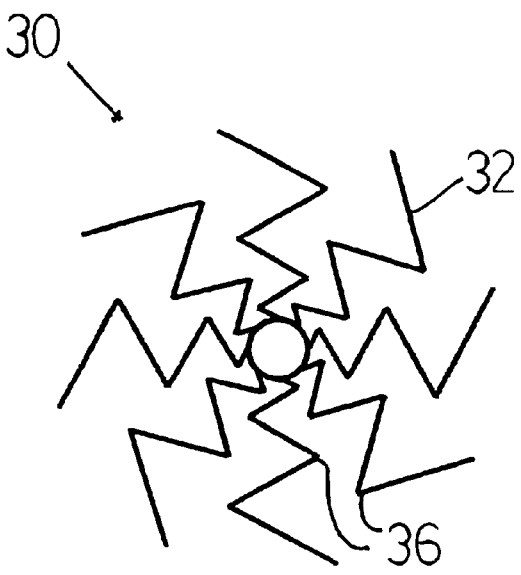
FIG. 7 shows a top view of a third embodiment of insert according to the invention.
Figure 8:
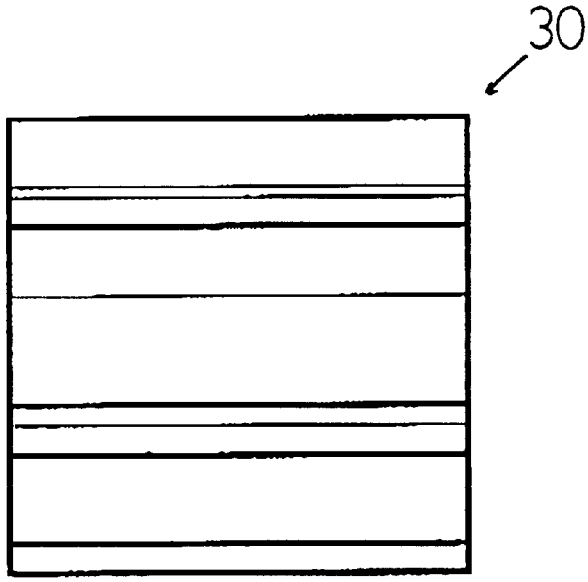
FIG. 8 shows a side view of the third embodiment.
Figure 9:
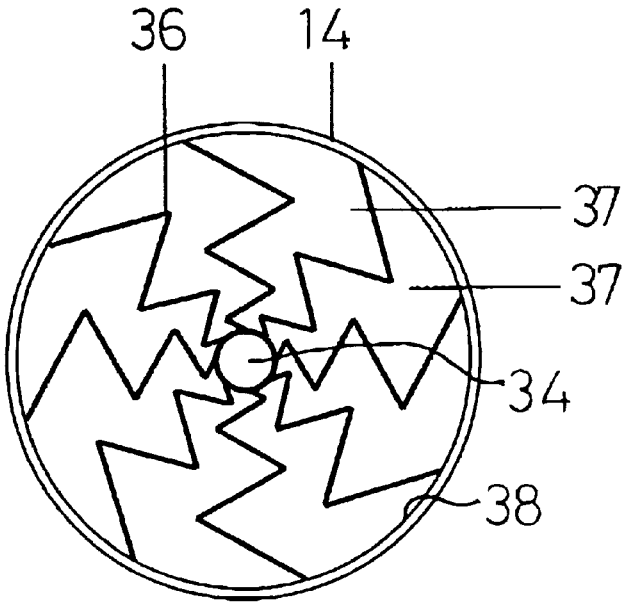
FIG. 9 show a top view of the third embodiment located in a drinks vessel.

FIGS. 7, 8 and 9 show an insert 30 with flexible concertina arms 32 (which may be parallel, tapered or rounded corresponding to the form of the drinks vessel 14 with which it is to be used). The arms are joined to a central core 34 which may be solid or hollow. By virtue of the flexible junctions 36 between adjacent sections of the concertina arms 32 the insert may be compressed to suit the diameter of the vessel 14. Cells 36 for liquid are created which have a small area.

In the embodiment of FIGS. 7–9 the junctions 36 are resilient and seek to extend the arms 32, so that when the arms 32 are released they are biassed into frictional engagement with the wall 38 of the vessel.

Figure 10:
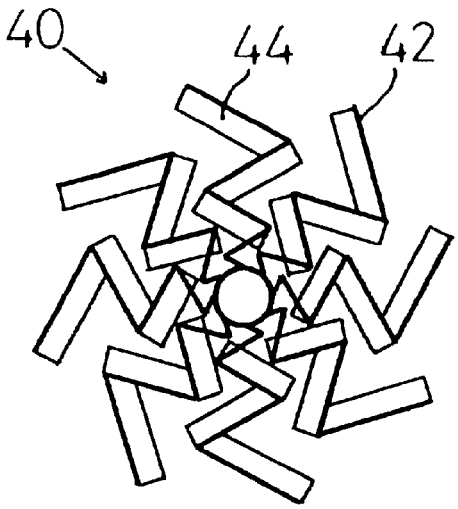
FIG. 10 shows a top view of a fourth embodiment of insert according to the invention.
Figure 11:
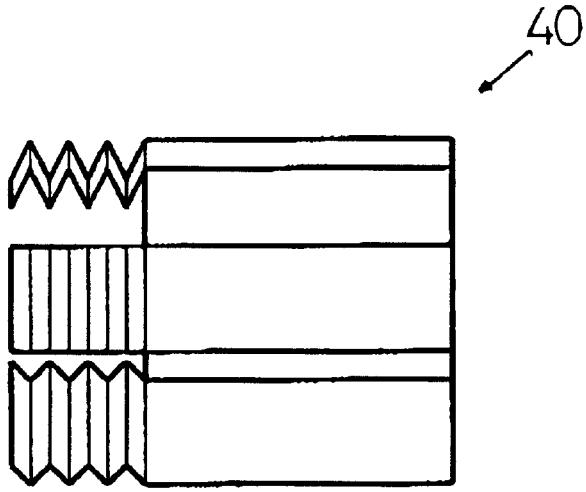
FIG. 11 shows a partial side view of the fourth embodiment.
Figure 12:
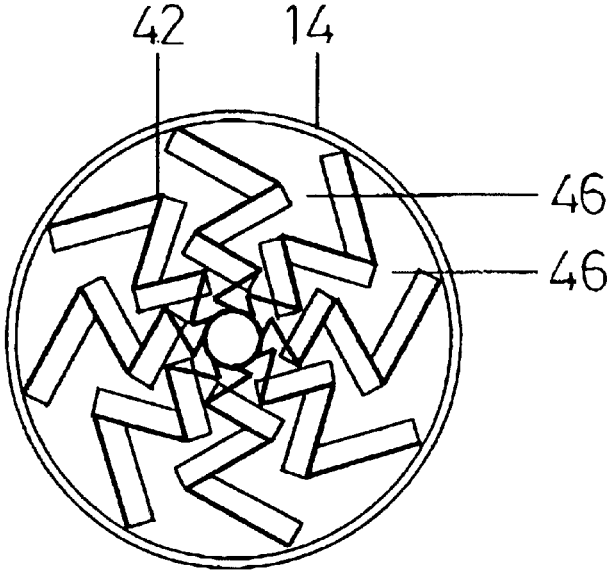
FIG. 12 show a top view of the fourth embodiment located in a drinks vessel.

FIGS. 10, 11 and 12 show an insert 40 somewhat similar to the insert 30 but with the arms 42 carrying additional concertina sections 44 which allow the insert 40 also to be compressed to suit the depth (or height) of the vessel 14 into which it is inserted.

The partial side sectional view of FIG. 11 shows only three of the arms 42, for the sake of clarity.

Figure 13:
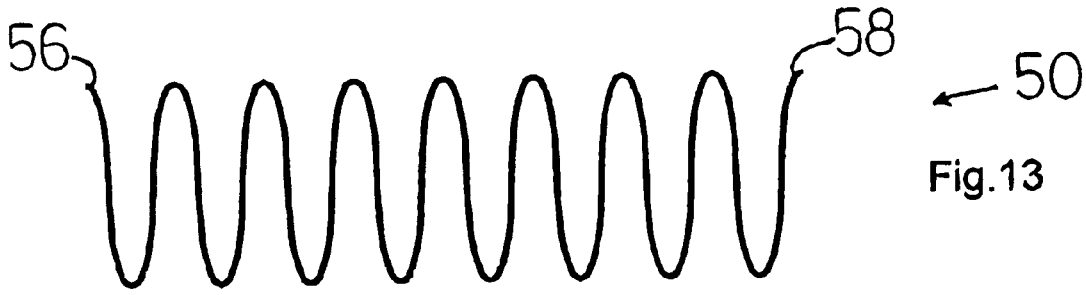
FIG. 13 shows a top view of a fifth embodiment of insert according to the invention.
Figure 14:
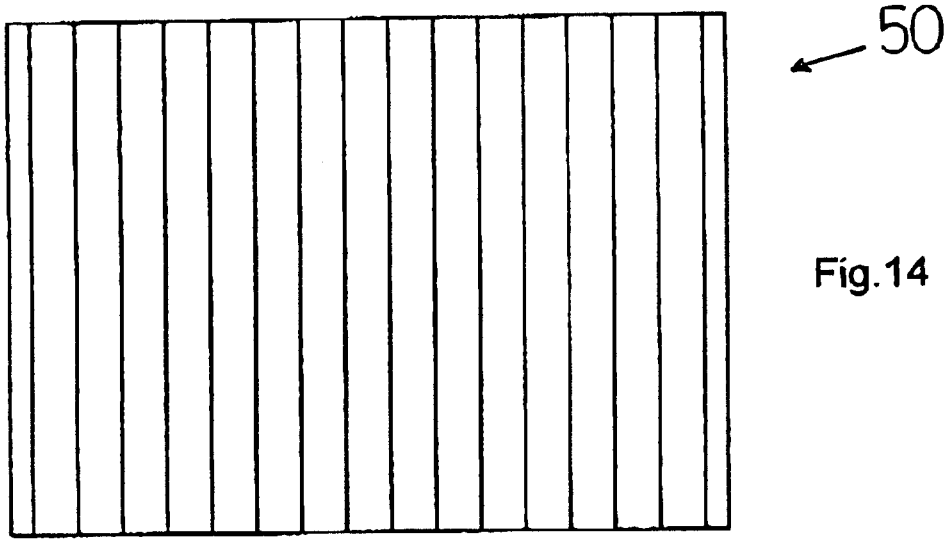
FIG. 14 shows a side view of the fifth embodiment.
Figure 15:
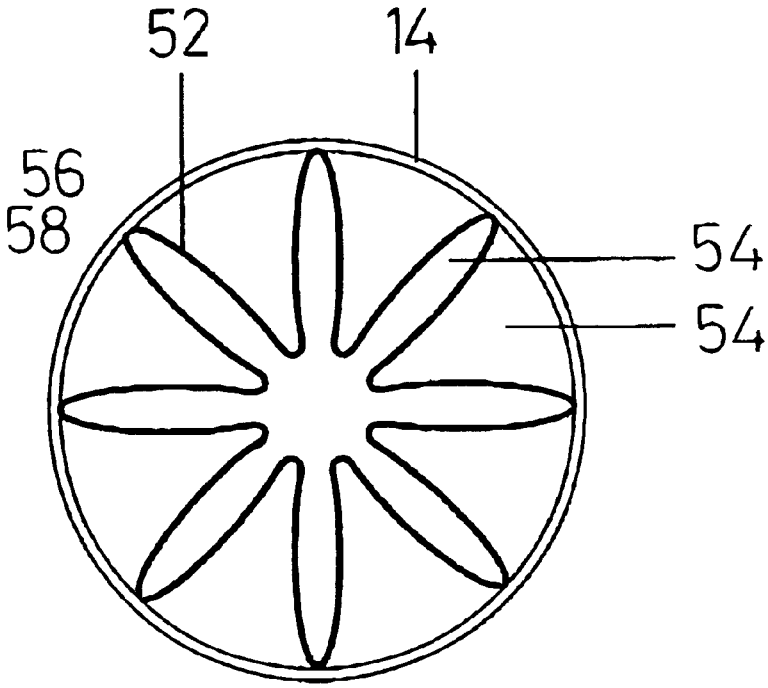
FIG. 15 show a top view of the fifth embodiment located in a drinks vessel.

FIGS. 13, 14 and 15 show an insert 50 of corrugated form. The insert 50 may be rolled into a generally circular shape (see FIG. 15) to form lobes 52. The insert 50 is flexible and resilient, and can be compressed to suit the diameter of the vessel 14 into which it is inserted. Cells 54 for liquid are created which have a small surface area.

In the embodiment of FIGS. 13–15 the insert 50 is suited precisely to the drinks vessel 14, i.e. the ends 56,58 of the insert closely abut when the inserted into the drinks vessel 14. In other embodiments such close abutment is not present, and the ends 56,58 can overlap each other, or there can be a gap therebetween, without significantly reducing the effectiveness of the insert.

Figure 16:
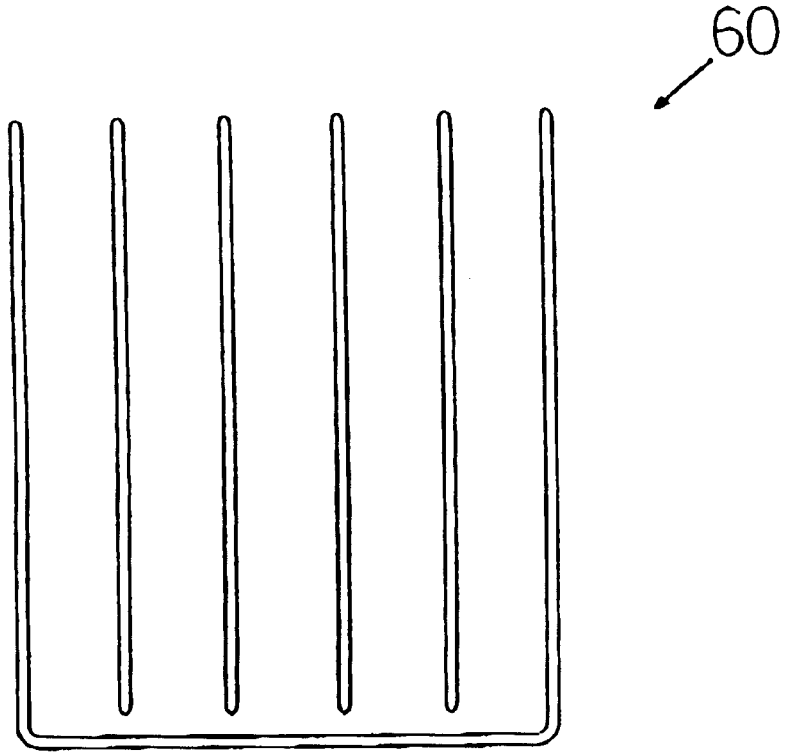
FIG. 16 shows a sectional view of a first embodiment of drinks vessel according to the invention.
Figure 17:
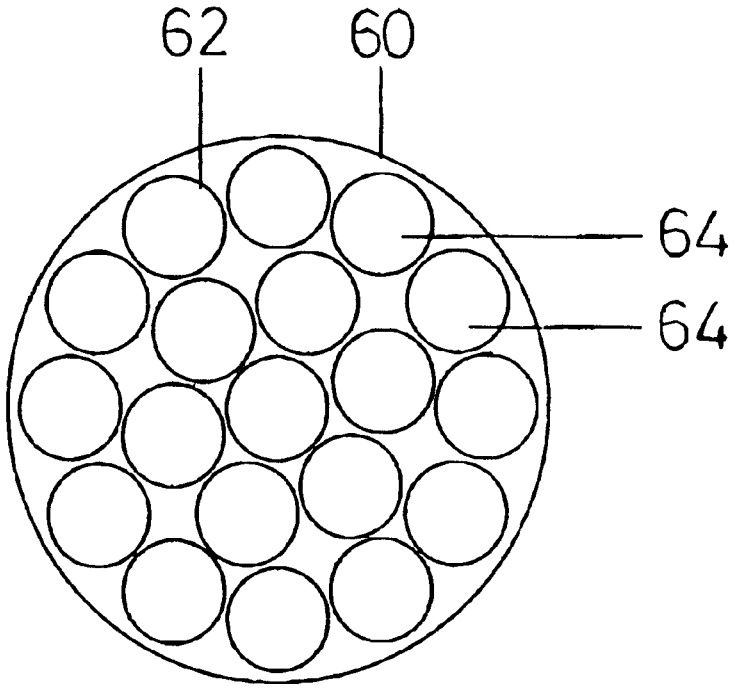
FIG. 17 shows a top view of the drinks vessel of FIG. 16.

FIGS. 16 and 17 show a rigid vessel 60 with an integral cellular structure formed of tube members 62. Cells 64 for liquid are created within and between the tube members 62, which cells have a small surface area and a small volume. The cellular structure of the embodiment of FIGS. 16 and 17 may be preformed and secured to the wall 66 of the drinks vessel as part of the manufacturing process of the drinks vessel.

It will be understood that the cellular structure of the embodiment of FIGS. 16 and 17, comprising the set of tube insert for a drinks vessel 14.

Figure 18:
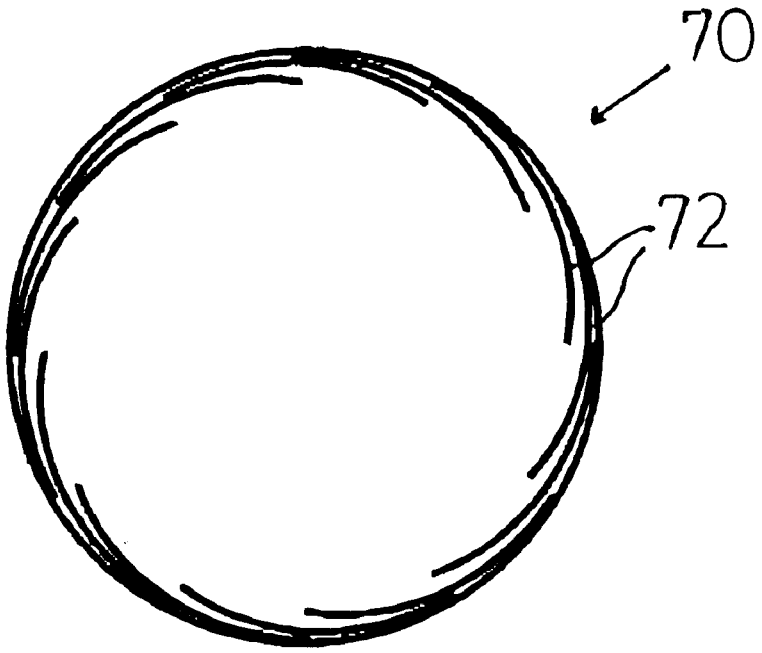
FIG. 18 shows a top view of a second embodiment of drinks vessel, in a stackable condition.
Figure 19:
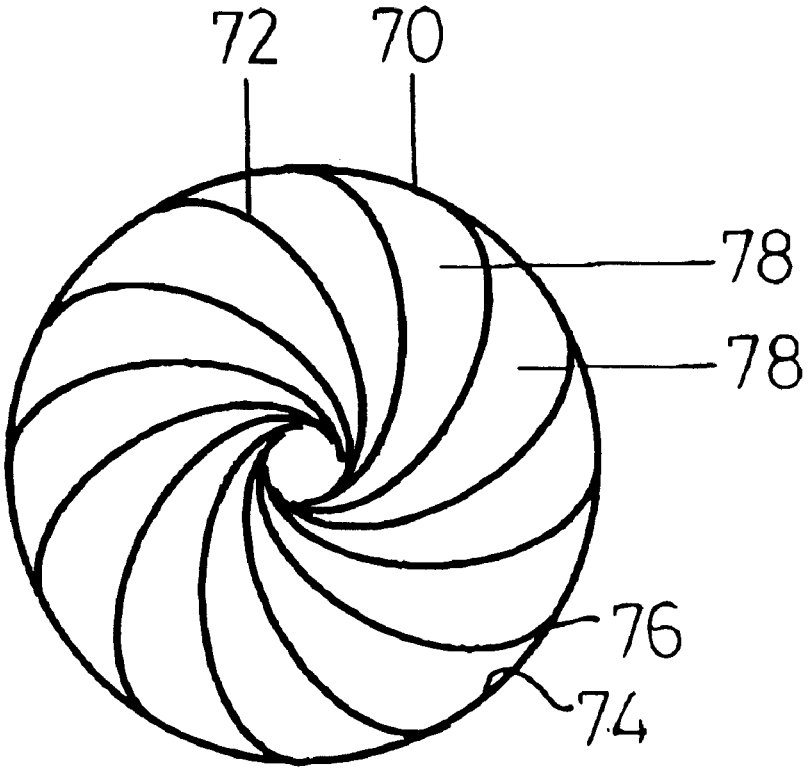
FIG. 19 shows a top view of the second embodiment of drinks vessel, in a usable condition.

FIGS. 18 and 19 show a flexible, stackable, drinks vessel 70 with flexible spiral arms 72 which are permanently attached to the wall 74 of the vessel The arms 72 are each joined to the wall 74 by a flexible and resilient joint 76, and when the drinks vessel is unstacked (i.e. a similar drinks vessel 70 is removed from between the arms 72 in the condition of FIG. 18), the arms 72 are resiliently biassed towards the centre of the vessel, and create cells 78 for liquid, which cells have a small surface area. As an alternative to the arms being resiliently biassed they may be drawn towards the centre of the vessel by a link to the inner stacked vessel, as that inner stacked vessel is removed.

As another alternative, the arms may be of concertina form and be fixed to the base of the vessel. The arms of the first vessel may be collapsed whilst an inner vessel is stacked therewithin, but may become erected as the inner vessel is removed. The erection may be by way of the arms being resilient, or by way of a link to the inner vessel.

The drinks vessel 70 is preferably tapered slightly, to allow one drinks vessel to be stacked within an identical drinks vessel.

As will be clear from FIG. 16, the tube member 62 do not extend to the bottom of the vessel 60. In this way, as liquid is consumed from one cell 64 it can be replaced by liquid from the remaining cells, so that the level of liquid in each cell remains substantially the same as the other cells, notwithstanding that the user may drink from only one cell.

It will be understood that the inserts 10,20,30,40 and 50 creating the cells of the other embodiments may be arranged not to extend completely to the bottom of the vessel when in use, for similar purpose. To facilitate this, the central core 16,34 can extend beyond the bottom edge of the remainder of the insert, the central core intended to be positioned to rest on the bottom of the vessel 14 in use. Alternatively, the insert can include one or more extensions to act as feet so as to space the remainder of the insert from the bottom of the vessel.

The arms 12, 24, 32 or 42 or lobes 52, or tube members 62 (as applicable) may also be apertured to allow fluid to pass from one cell to another in addition to, or instead of, by way of the bottom of the vessel.

The inserts 10,20,30,40 and 50 may be manufactured as a moulding, as an extrusion, or as a fabrication, as desired or appropriate.

In yet another embodiment there is provided a shaped sponge-like insert of open-cell structure suitable for insertion into a conventional drinks vessel, and which in use effectively divides the drinks vessel into a number of connected cells of liquid of small surface area and small volume.

What is claimed is:

1. An insert for placement within a liquid vessel, the insert having at least two wall members which are adapted to contact a surface within the vessel and span at least part of vessel in use so as to divide a liquid present within the vessel, each wall member comprising at least one vane member transversely attached to the wall member and not attached to adjacent wall members.

2. The insert as claimed in claim 1 wherein the insert has a number of wall members, the wall members spanning different parts of the vessel in use.

3. The insert as claimed in claim 2 wherein the wall members are connected together.

4. The insert as claimed in claim 3 wherein the wall members are mounted upon a core member.

5. The insert as claimed in claim 3 wherein the wall members completely span the height of the vessel.

6. The insert as claimed in claim 1 wherein the insert is removably mountable in the vessel.

7. The insert as claimed in claim 1 wherein the insert is flexible.

8. The insert as claimed in claim 7 wherein the insert is resilient.

9. The insert as claimed in claim 1 wherein the wall member is of arcuate form.

10. The insert as claimed in claim 1 having at least one spacing member adapted in use to space the wall member from the bottom of the vessel.

11. The insert as claimed in claim 1 in which a part of the wall member is apertured so as in use to permit liquid to pass therethrough.

12. A liquid vessel including an insert as claimed in claim 1, wherein at least a part of the vessel which is spanned by the wall member is adjacent to the top of the vessel.

13. The liquid vessel as claimed in claim 12 which in use the insert divides the exposed surface of the liquid.

14. The liquid vessel as claimed in claim 12 wherein the wall member extends to near the bottom of the vessel.

15. The insert as claimed in claim 2 wherein each of the wall members carries at least one vane member transverse to the wall member that is non-contactable with the vessel surface.

* * * * *

UNITED STATES PATENT AND TRADEMARK OFFICE

CERTIFICATE OF CORRECTION

PATENT NO. : 6,398,064 B1
DATED : June 4, 2002
INVENTOR(S) : Roger William Cornwall It is certified that error appears in the above-identified patent and that said Letters Patent is hereby corrected as shown below:

Title page,
Before Primary Examiner insert -- [74] *Attorney, Agent or Firm* — Steven J. Hultquist; Marianne Fuierer --

Column 4,
Line 11, "insert for a drinks vessel 14." should be -- member 62, may alternatively be utilized as a removable insert for a drinks vessel 14. --
Line 14, "vessel The" should be -- vessel. The --

Signed and Sealed this

Eighteenth Day of March, 2003

JAMES E. ROGAN
*Director of the United States Patent and Trademark Office*